United States Patent [19]

Kals

[11] 4,240,499

[45] Dec. 23, 1980

[54] BALANCED WASTE HEAT RECOVERY AND DISSIPATION SYSTEM

[75] Inventor: Walter Kals, Hastings-on-Hudson, N.Y.

[73] Assignee: Niagara Blower Company, Buffalo, N.Y.

[21] Appl. No.: 930,909

[22] Filed: Aug. 4, 1978

[51] Int. Cl.[3] ..... F28F 27/00

[52] U.S. Cl. ..... 165/1; 62/305; 165/39; 165/40; 165/DIG. 12; 237/2 R; 237/12.1; 236/38; 236/49

[58] Field of Search ..... 165/107, 1, DIG. 2, 165/39, 40; 237/5, 2, 12.3 B, 12.1; 236/38, 49; 62/238 E, 305

[56] References Cited

U.S. PATENT DOCUMENTS

| | | | |
|---|---|---|---|
| 2,213,018 | 8/1940 | Perkins | 236/38 X |
| 3,186,183 | 6/1965 | Murdoch | 62/305 X |

*Primary Examiner*—Albert W. Davis

*Attorney, Agent, or Firm*—Hosier, Niro and Daleiden

[57] ABSTRACT

A system for recovering and utilizing, to a controlled and variable extent, waste heat from a coolant fluid. The amount of heat recovery varies in proportion to the marginal costs associated therewith. Heat laden coolant passes through an interior heat exchanger where heat may be extracted in varying amounts from the coolant by a thermostatically-controlled air mover, the air mover admitting outside air past the interior heat exchanger. The coolant proceeds to an exterior wet surface heat exchanger where residual heat is concurrently extracted from the coolant by a thermostatically-controlled combination of ambient air, recirculated ambient air, and water spray. The coolant then returns to the beginning of its cycle. The temperature of outside air is the principal variable determining the proportion of heat recovered by the interior heat exchanger and the proportion extracted by the exterior heat exchanger. The total heat extracted reduces the coolant temperature to a predetermined operating level.

14 Claims, 1 Drawing Figure

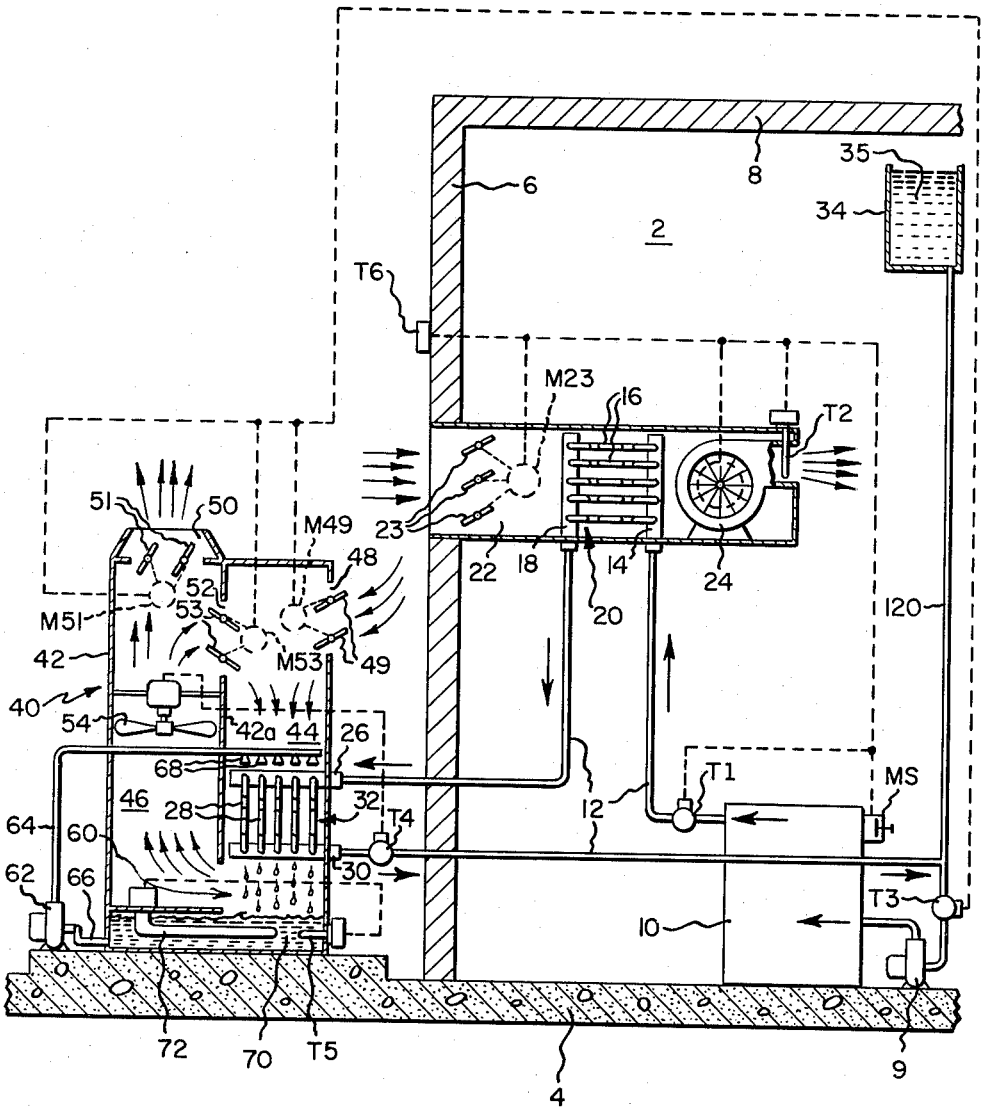
35
34
8
6
2
T6
M23
16
T2
51
50
M49
23
48
22
18
14
24
52
53
20
120
M51
42
M53
49
40
54
42a
44
26
68
T1
MS
46
28
32
12
64
60
T4
30
62
66
T3
10
72
70
T5
4
9

BALANCED WASTE HEAT RECOVERY AND DISSIPATION SYSTEM

BACKGROUND

The subject matter is heating and cooling and more particularly a predetermined variable recovery of waste heat from a coolant fluid for positive use in combination with a coordinated dissipation of unrecovered heat.

An environment where the system of this invention might be used, for example, is in an industrial plant having heat engines or other equipment of the type generating heat and requiring a coolant fluid. The heat carried away from such machinery by a coolant fluid has heretofore generally been dumped by means of the most convenient sink. In addition, the prior art teaches the utilization of reclaimed heat in an air intake duct through which fresh outdoor air is supplied to the interior of a building. In such instances, the prior art employs apparatus for selectively utilizing equipment generated energy to heat fresh outdoor air during winter months, for example, and wasting the equipment generated energy to atmosphere during warmer months. In other words, the prior art teaches the use of two independent sub-systems—one being used to heat indoor air and the other being used to waste heat to the outdoors. However, a significant drawback encountered in employing two such independent systems resides in the fact that the potential advantages offered by both cannot be realized in a coordinated sense since only either the indoor heat recovery system or the outdoor heat dissipation system is used at one time. Due to changing ambient conditions and heat generation rates, it has been found desirable to only recover a certain proportion of heat from a coolant fluid while dissipating a certain proportion thereof to atmosphere.

For example, heat recovery is most efficient when fresh outside air passed over the interior heat exchanger is very cold and, of course, this efficiency decreases as the outside air temperature increases. One of the effects of such decreasing efficiency with respect to outside air temperature is the increased consumption of electrical energy for a fan or blower to pass outside air over the interior heat exchanger so as to recover any given amount of thermal energy. Within the context of the present invention, an exterior wet surface heat exchanger is preferred for dissipation of heat to atmosphere since the latent heat of evaporation associated with the exterior exchanger provides the capacity to dissipate heat at a greater rate than the sensible heat which can be transferred by the interior heat exchanger for a given air flow. Accordingly, as the temperature of the air passed through the interior heat exchanger increases, the marginally increasing cost of electricity for the blower/fan associated therewith per BTU recovered will not be warranted in comparison to the lesser amount of electrical energy which would be consumed by the blower/fan associated with the more efficient exterior wet surface heat exchanger to dissipate the same quantity of heat from the liquid coolant.

When not employing a coordinated interior and exterior heat exchange system, other disadvantages may be encountered. For example, when drawing outside air over the interior heat exchanger for recovery purposes, the liquid coolant may be of a temperature that it must be cooled but may not be of a sufficient temperature to warrant drawing in cold outside air for interior heating purposes. In addition, there would be the further drawback of relatively greater energy consumption by the interior blower/fan if the interior heat exchanger were to be used as opposed to simply dissipating the excess coolant heat to atmosphere by means of the more efficient exterior, wet surface heat exchanger. Also, and in a sense similar to the coolant not having sufficient excess heat to warm up a given flow of air through the interior heat exchanger to a desired temperature level, the temperature of the would be air flow to be passed through the interior heat exchanger may be so low that it can't be brought up to a desired temperature level whereby it would be more efficient to simply dissipate the excess coolant heat to atmosphere.

SUMMARY OF THE INVENTION

Accordingly, a primary object of the present invention is to provide a combined heat recovery/heat wasting system which operates in a coordinated manner so as to avoid the recovery of heat which, being useful, is however, not justified in view of the marginally greater operational expenses incurred with respect to the amount of useful heat recovered.

Another object of the present invention is to provide a combined and coordinated heat recovery/heat wasting system which recovers heat from a coolant flow by the passage of outdoor air over an interior heat exchanger only when the temperature of the outside air flow becomes raised to a predetermined level.

In summary, the present invention discloses a method and apparatus for both recovering and wasting heat from a liquid coolant flow in a coordinated manner. A liquid coolant flow is circulated in a closed loop manner through a heat generation source such as industrial machinery housed within a manufacturing facility, for example. The coolant flow passes through an interior heat exchanger and through a wet surface exterior heat exchanger and is returned to the heat generation source. Outside air is drawn over the interior heat exchanger when heat recovery is to take place, taking into account that it will be desired to raise the outdoor air flow to a predetermined temperature level. The exterior, wet surface heat exchanger operates to dissipate excess coolant heat to atmosphere whether or not the interior heat exchanger is operational, the latter depending on ambient atmospheric conditions. The wet surface, exterior heat exchanger is housed in such a manner as to (1) insure its uninterrupted wet-surface condition without icing at subfreezing ambient temperatures; (2) being capable of dissipating all heat during extreme summer weather, yet being able to dissipate only a small fraction of that heat on all but the coldest days; (3) to preclude the possibility of freezing the coolant contained in its tubular system if, for example, this coolant is water. Failure to meet the requirements listed above would cause the difficulties enumerated in the same order as follows:

(1) Periodic drying of the wet surface would lead to the formation of scale on that surface;

(2) Inability to adjust the cooling effect would result in an undesirable reduction of the coolant temperature;

(3) Freezing would cause the rupture of tubing.

The foregoing and other objects, advantages and characterizing features of the present invention will become clearly apparent from the ensuing detailed description of an illustrative embodiment thereof, taken together with the accompanying drawing where like reference characters denote like parts throughout.

BRIEF DESCRIPTION OF THE DRAWING

The single drawing FIGURE is a schematic representation of the combined recovery and wasting system according to this invention.

DESCRIPTION

An environment for the use of this invention is represented by an interior space or enclosure 2 supported on a floor 4 and enclosed by walls 6 and a roof 8. The space and air exterior to the enclosure 2 will be designated 1 for convenience.

A heat engine, or other equipment of the type generating heat, is schematically represented at 10. Equipment 10 might be any or all of a variety of machinery; for purposes of the present invention, it need not be considered more specifically than as a source of heat to be dissipated as for example the engine heat of an automobile is dissipated by a radiator. Equipment 10 is maintained at operating temperature, i.e. cooled by a cooling system including a closed coolant loop 12.

Coolant loop 12 passes from a motor-driven coolant pump 9 through the heat source 10, and proceeds to intake header 14, a tube bundle 16 and outflow header 18, headers 14, 18 and tubes 16 together forming an interior heat exchanger or air heater 20 within the enclosure 2. Air heater 20 is disposed within an air duct 22 which leads from the exterior 1 through an opening in the wall 6 and into the enclosure 2. Duct 22 is either open or closed by louvers 23 which are operated by a motor M23. A fan 24 is also operatively located in the air duct 22 and operates to draw air from the exterior, through the duch 22 over the heat exchanger 20 and into the enclosure 2.

Coolant loop 12 extends from the air heater 20 through wall 6 to the intake header 26, tube bundle 28, and outflow header 30 of an exterior heat exchanger 32 located outside of the enclosure 2. Coolant loop 12 then returns to the suction side of the coolant pump 9. An elevated and vented water tank 34 containing a coolant reserve 35 also connects, through line 120, with the coolant loop 12 on the suction side of pump 9 to keep the loop 12 filled and vented.

An outside air ducting system is generally indicated at 40 and includes duct work 42 defining an air intake duct 44 and an air discharge duct 46 separated by a center partition **42*a*. Intake duct 44 communicates with outside air through a louvered air intake opening 48. Discharge duct 46 communicates with outside air through a louvered air discharge opening 50. A louvered recirculation opening 52 in the partition 42*a* effects a short circuit or recirculation loop from discharge duct 46 to intake duct 44. Openings 48, 50 and 52 can be varied between substantially fully open and substantially fully closed conditions by louvers 49, 51 and 53 which are in turn operated by motors M49, M51 and M53 respectively. Heat exchanger 32 is disposed in intake duct 44 and a fan or blower 54 is disposed in discharge duct 46. Duct 44 leads directly into duct 46 under the partition 42*a* so that ducts 44, 46 are in fact a series air ducting system from air intake opening 48, past heat exchanger 32 and fan 54, to air discharge opening 50**.

A water spray or cascade system for heat exchanger 32 is generally indicated at 60 and includes a motor-driven water pump 62 connected to a discharge line 64 and a suction line 66. Discharge line 64 leads into the air intake duct 44 and a plurality of spray orifices 68 which discharge or spray cascading water over the tube bundle 28 of heat exchanger 32. Heat exchanger 32 is thus a wet-surface, air-cooled heat exchanger. Spray water falling from the heat exchanger 32 collects in a reservoir 70 which leads back to water pump 62 through suction line 66 for continuous operation. A thermostatically-controlled immersion heater 72 is immersed in the water reservoir 70 to maintain the water temperature at an appropriate level in an extreme weather condition where freezing might otherwise occur. As considered hereinbelow, in cold weather, a portion of the air quantity discharged by the fan 54 is recirculated through opening 52 and is mixed with a correspondingly reduced air quantity entering through the opening 48. The resulting air mixture will never be unduly cold, as relatively warm air discharged by the fan 54 is blended with relatively cold air entering through the opening 48.

A hot coolant thermostatic control T1 is located in the coolant loop 12 downstream of the heat source 10 to sense the temperature of coolant at that location and is controllably connected to fan 24 and louvers 23. An air thermostatic control T2 is located in the air duct 22 downstream of fan 24 to sense the temperature of air at that location and is controllably connected to fan 24 and louvers 23. A coolant thermostatic control T3 is located in the coolant loop 12 on the suction side of coolant pump 9 to sense the temperature of coolant at that location and is controllably connected to the air intake, discharge and recirculating louvers 49, 51 and 53. A second coolant thermostatic control T4 is located in the coolant loop 12 downstream of heat exchanger 32 to sense the temperature of coolant at that location and is controllably connected to fan 54 moving air through the ducting system 40. A thermostatic control T5 is located in the reservoir 70 to sense the temperature of the heat sink water therein and is controllably connected to the immersion heater 72. A manual switch MS is tied into the control lines with thermostatic controls T1 and T2 for momentary, manual override of these two controls. Motor-driven coolant pump 9 and the water spray pump 62 are normally continuously operating.

OPERATION

In operation, coolant from pump 9 is pumped through the heat source 10, extracting heat and thereby cooling the same. The coolant, thus heated, passes through the air heater 20 giving up heat to the air moving through the duct 22 and into the enclosure space 2 to heat the same. Of course, if the coolant does not have a sufficient heat capacity and/or if the outside air is too cold so that its temperature cannot be raised to a predetermined level, as monitored by controls T1 and T2 respectively, then no air flow will pass through duct 22 over air heater 20. From air heater 20 the coolant then proceeds to the external heat exchanger 32 where it may be further cooled, or cooled in the first instance as dependent on whether the heat exchanger 20 is or is not operative, before returning to the pump 9 where the cycle is repeated.

In the external air system 40, external air is admitted through louvers 49 into duct 44 and passes over the heat exchanger 32 to absorb heat from the coolant in the tubes, and passes through duct 46, discharging to atmosphere through louvers 51. A portion of the air flow in duct 46 may be recirculated back into the intake duct 44 through recirculation opening 52 and louvers 53 for mixing with a correspondingly reduced air flow intake through opening 48. The water spray from orifices 68 adds substantially to the cooling capacity of the air passing over and through the tube bundle 28 of heat exchanger 32.

The varying temperature conditions of ambient outside air, i.e. seasonal variations, will result in varying conditions within the system. The stream of coolant flows continuously at full rate through the coolant loop 12 including the air heater 20 and the wet-surface, air-cooled heat exchanger 32. In warm weather or when no air heating is needed, the fan 24 will simply be cut off and louvers 23 closed. In cold weather or when air heating is needed, fan 24 will run and louvers 23 will be open, but only if the coolant in loop 12 is sufficiently warm. This mode of operation will continue if the heated outdoor air remains sufficiently warm.

The wet-surface, air-cooled heat exchanger 32 functions to proportion the required reduction in coolant temperature between heat recovery (at the internal air heater 20) and its own dissipation of excess coolant heat remaining. It permits substantial heat dissipation in milder weather, and no heat recovery—full dissipation in warm weather.

Neither the fan 24 nor the louvers 23 vary the flow of fresh air to be heated. Whenever the fan 24 runs, louvers 23 are wide open, and they are fully closed when the fan is off. The coolant flow through loop 12 is at a constant rate and its temperature at the coolant circulating pump 9 is controlled. This temperature control is achieved by proportioning the circulation and recirculation of air in the wet-surface, air-cooled heat exchanger 32. This, in turn, is achieved by controlling the several louvers 49, 51 and 53 from thermostatic control T3 and by controlling the fan 54 from thermostatic control T4.

The internal heat exchanger or air heater 20 is protected from freezing by louvers 23. External heat exchanger 32 is protected from freezing by the system of proportioned air recirculation. Upon total recirculation of air over heat exchanger 32, fan 54 will be shut off by control T4 if the temperature of coolant at that point is lower than a set value. If the coolant temperature should continue to drop, the heat exchanger 32 would be protected from freezing by heating (as controlled by T5) the continuous water cascade from reservoir 70 by the heater 72.

Accordingly, if coolant entering the heat exchanger 20 is sufficiently warm, thermostat T1 will signal fan 24 to run and louvers 23 to open. However, if the air, from anywhere outside of enclosure 2, thus drawn in is too cold for being heated to a set temperature, thermostat T2 will signal fan 24 to stop and louvers 23 to close. Thermostat T1 is a multi-output control, such as model B27A marketed by United Electric Corporation, which means that an output signal will be produced at several increments of rising water temperature. Thus, if the coolant temperature rises by a sufficient increment whereby a warmer air supply to the enclosure 2 can be produced, the thermostat T1 will again signal fan motor 24 to run and louvers 23 to open. If the temperature of the air from fan 24 is maintained above a setting of thermostat T2, fan 24 will be kept running and louvers 23 kept open. If not, the fan will again stop and another incremental increase in coolant temperature as T1 will required to restart it.

In any event, the outside heat exchanger automatically compensates for heat not removed by the air heater 20 so as to reduce the coolant temperature to a predetermined level. By manual operation of switch MS, an operator can at any time start fan 24 and open louvers 23, but this condition will only continue (after switch MS is released) if the air temperature at thermostat T2 is above the setting of thermostat T2. With this method of control, freezing of circulating coolant in the heat exchanger 20 is avoided, since cold outdoor air will only strike the tube bundle 16 if the coolant temperature is sufficiently high and if a sufficiently high temperature of air from fan 24 to thermostat T2 and enclosure 2 is maintained. Furthermore, fan 24 will run, and louvers 23 open, only if coolant pump is running to maintain circulation through the system.

It is in regard to a primary feature of the present invention that temperature sensor T6 disposed on the exterior of enclosure 2 will be described.

Sensor or thermostat T6 monitors the atmospheric temperature with respect to the air which may be drawn in through duct 22. The thermostatic control T6 functions to close louvers 23 and shut off fan 24 (thereby precluding any heat recovery) when the outside air temperature is at or above a predetermined level on the order of 50° to 60° F., for example. As considered hereinabove, the wet surface exterior heat exchanger is more efficient in dissipating heat from the coolant for a given fan induced flow than is the interior air heater 20 for a commensurate fan flow. Since the marginal recovery of heat provided by the interior heat exchanger 20 decreases as the outside air temperature increases, it becomes less and less desirable to expend energy in driving fan 24 associated with the interior air heater as opposed to allowing the more efficient exterior heat exchanger to dissipate all of the excess heat in the coolant flow. In other words, at a given outside temperature the marginal cost of driving fan 24 becomes more than the marginal worth of the heat recovered.

Having thus described and illustrated a preferred embodiment of my invention, it will be understood that such description and illustration is by way of example only and that such modifications and changes as may suggest themselves to those skilled in the art are intended to fall within the scope of the present invention as limited only by the appended claims.

I claim:

1. A system for selectively recovering heat from a coolant fluid wherein the latter absorbs heat from heat generating equipment to cool the same and heat recovered from the fluid warms an enclosed air space, said system including:

a first heat exchanger for recovering heat from said coolant fluid by warming air moving therethrough into said enclosed air space, a second heat exchanger for cooling said coolant fluid to a predetermined temperature by dissipating excess heat not recovered by said first heat exchanger, circulating means for circulating said coolant fluid through said heat generating equipment and said first and second heat exchangers, air moving means for effecting an air flow through said first heat exchanger, air flow thermosensitive means operatively connected to said air moving means and disposed to sense the temperature of said air flow downstream of said first heat exchanger, said air flow thermosensitive means being responsive to the temperature of said air flow to permit said air moving means to be operative when the temperature of said air flow is above a predetermined level and to render said air moving means inoperative when the temperature of said air flow is below said predetermined level, and means for restarting said air moving means at predetermined intervals when the latter is inoperative so that said air flow thermosensitive means will sense a temperature rise of said air flow above said predetermined level upon corresponding changes in operating conditions whereupon said air moving means would continue to be operative.

2. A system as defined in claim 1 wherein said second heat exchanger comprises a wet-surface, air-cooled heat exchanger.

3. A system as defined in claim 1 further including coolant thermosensitive means operatively connected to said air moving means and disposed to sense the temperature of said coolant fluid downstream of said heat generating equipment and upstream of said first heat exchanger, said coolant thermosensitive means being responsive to the temperature of said coolant fluid to permit said air moving means to be operative when said coolant temperature is above a predetermined temperature level and to render said air moving means inoperative when said coolant temperature is below said predetermined temperature level.

4. A system as defined in claim 1 in which said air moving means includes fan means and louver means through which air outside of said enclosed air space may pass to the latter.

5. A system as defined in claims 1, 2, 3 or 4 including a second air moving means to selectively effect an air flow through said second heat exchanger to cool said coolant to said predetermined temperature and coolant thermosensitive means, responsive to the temperature of said coolant downstream of said second heat exchanger and upstream of said first heat exchanger being in operative connection with said second air moving means to control the same.

6. A system as defined in claim 5 wherein said second air moving means includes louver means selectively operable to recirculate at least a portion of said air flow associated therewith back through said second heat exchanger so as to raise the temperature of the resulting air flow through said second heat exchanger should the temperature of said coolant fall below its predetermined temperature in said second heat exchanger.

7. A system as defined in claim 6 including heating means to selectively heat said second heat exchanger should the temperature of said coolant fall below its predetermined temperature in said second heat exchanger, said coolant thermosensitive means responsive to the temperature of said coolant downstream of said second heat exchanger and upstream of said first heat exchanger being in operative connection with said heating means to control the same.

8. A system as defined in claims 1, 2, 3, or 4 wherein said second heat exchanger is more efficient than said first heat exchanger with respect to operational energy required in absorbing heat from said coolant fluid, and said system includes thermosensitive means, operatively connected to said air moving means associated with said first heat exchanger, and being responsive to the temperature of said air flow upstream of said first heat exchanger so as to render said air moving means inoperative when the marginal value of the heat which would otherwise be recovered by said first heat exchanger is less than the marginal value of the energy saved by allowing said second heat exchanger to cool said coolant fluid to its predetermined temperature by dissipating all excess heat therein.

9. A system as defined in claim 5 wherein said second heat exchanger is more efficient than said first heat exchanger with respect to operational energy required in absorbing heat from said coolant fluid, and said system includes thermosensitive means, operatively connected to said air moving means associated with said first heat exchanger, and being responsive to the temperature of said air flow upstream of said first heat exchanger so as to render said air moving means inoperative when the marginal value of the heat which would otherwise be recovered by said first heat exchanger is less than the marginal value of the energy saved by allowing said second heat exchanger to cool said coolant fluid to its predetermined temperature by dissipating all excess heat therein.

10. A system as defined in claim 6 wherein said second heat exchanger is more efficient than said first heat exchanger with respect to operational energy required in absorbing heat from said coolant fluid, and said system includes thermosensitive means, operatively connected to said air moving means associated with said first heat exchanger, and being responsive to the temperature of said air flow upstream of said first heat exchanger so as to render said air moving means inoperative when the marginal value of the heat which would otherwise be recovered by said first heat exchanger is less than the marginal value of the energy saved by allowing said second heat exchanger to cool said coolant fluid to its predetermined temperature by dissipating all excess heat therein.

11. A system as defined in claim 7 wherein said second heat exchanger is more efficient than said first heat exchanger with respect to operational energy required in absorbing heat from said coolant fluid, and said system includes thermosensitive means, operatively connected to said air moving means associated with said first heat exchanger, and being responsive to the temperature of said air flow upstream of said first heat exchanger so as to render said air moving means inoperative when the marginal value of the heat which would otherwise be recovered by said first heat exchanger is less than the marginal value of the energy saved by allowing said second heat exchanger to cool said coolant fluid to its predetermined temperature by dissipating all excess heat therein.

12. A method for selectively recovering heat from a coolant fluid wherein the latter absorbs heat from heat generating equipment and warming an enclosed air space with recovered heat while concurrently dissipating unrecovered heat, said method including the following steps:

passing said coolant fluid through said heat generating equipment to absorb heat therefrom, passing said coolant through a first heat exchanger within an enclosed air space, selectively passing air through said first heat exchanger and into said enclosed air space after being warmed by said first heat exchanger, monitoring the temperature of the air passing through said first heat exchanger on the downstream side thereof and stopping the passage of air through said first heat exchanger when the temperature thereof downstream of said first heat exchanger is less than a predetermined level, passing said coolant through a second heat exchanger to cool said coolant fluid to a predetermined temperature by dissipating excess heat not recovered by said first heat exchanger, and passing air through said first heat exchanger at predetermined intervals after the passage of air therethrough has stopped, sensing any temperature rise of said passage of air downstream of said first heat exchanger to or above said predetermined level as resulting from corresponding changes in operating conditions, and continuing to pass air through said first heat exchanger as long as said temperature downstream of said first heat exchanger is at or above said predetermined level.

13. A method as set forth in claim 12 including the step of passing water over the surface of said second heat exchanger so as to cause evaporated cooling thereof.

14. A method as set forth in claims 12 or 13 wherein said second heat exchanger is more efficient than said first heat exchanger in absorbing heat from said coolant fluid, and including the step of monitoring the temperature of the air passing through said first heat exchanger on the upstream side thereof and stopping the passage of air through said first heat exchanger when the maginal value of the heat which would otherwise be recovered thereby is less than the corresponding marginal value of the energy saved by allowing said second heat exchanger to cool said coolant fluid to its predetermined temperature by dissipating all excess heat therein.

* * * * *